US007444942B2

(12) United States Patent
Hall

(10) Patent No.: US 7,444,942 B2
(45) Date of Patent: Nov. 4, 2008

(54) SABOTED PROJECTILE WITH EXTERNAL RIDGES AND/OR INTERNAL LOCKING EDGE FOR MUZZLELOADING FIREARMS

(75) Inventor: Daniel W. Hall, Nampa, ID (US)

(73) Assignee: Accura Bullets, LLC, Nampa, ID (US)

( * ) Notice: Subject to any disclaimer, the term of this patent is extended or adjusted under 35 U.S.C. 154(b) by 71 days.

(21) Appl. No.: 11/318,076

(22) Filed: Dec. 23, 2005

(65) Prior Publication Data

US 2007/0144397 A1 Jun. 28, 2007

(51) Int. Cl.
*F42B 14/06* (2006.01)

(52) U.S. Cl. ..... 102/522

(58) Field of Classification Search ..... 102/522
See application file for complete search history.

(56) References Cited

U.S. PATENT DOCUMENTS 4,977,834 A * 12/1990 Denis ..... 102/439
5,214,238 A * 5/1993 Young ..... 102/520
5,404,816 A * 4/1995 Burri ..... 102/523
6,073,560 A * 6/2000 Stone ..... 102/522
6,481,356 B2 * 11/2002 Gualandi ..... 102/439
2003/0164111 A1 * 9/2003 Meyer et al. ..... 102/522

* cited by examiner

*Primary Examiner*—Michael J. Carone
*Assistant Examiner*—Gabriel J Klein
(74) *Attorney, Agent, or Firm*—Pedersen & Co., PLLC; Ken J. Pedersen; Barbara S. Pedersen

(57) ABSTRACT

The present invention is a saboted projectile with external ridges and/or an internal locking edge for muzzleloading firearms. Also, the present invention is a sabot with the ridges and/or locking edge for receiving a muzzleloading projectile. The sabot has a forward part and a rearward part. The forward part has a plurality of axial panel sections separated by narrow, axial slots. The panels have radial ridges on their outside, or external surfaces. Also, the panels have a radial ridge on their inside, or internal surfaces. The external radial ridges assist in convenient loading of the muzzleloading projectile, while still providing enough contact with the inside of rifle barrel to capture exploding gases and prevent blow-by. The internal radial ridge assists in securing the sabot to the bullet, especially when the bullet has been provided with a cooperating radial indent, cannelure or retaining ring. Consequently, when the saboted projectile of the present invention is seated in the bore in front of the power charge, the bullet will not easily separate from the sabot, and therefore, the bullet will not easily fall out of the barrel.

8 Claims, 5 Drawing Sheets

SABOTED PROJECTILE WITH EXTERNAL RIDGES AND/OR INTERNAL LOCKING EDGE FOR MUZZLELOADING FIREARMS

BACKGROUND OF THE INVENTION

1. Field of the Invention

This invention relates generally to firearms, and more specifically to muzzleloading firearms. The invention is a saboted muzzleloader projectile with external radial ridges for easier loading and/or a radial internal locking edge for securing the sabot to the bullet.

2. Related Art

U.S. Pat. No. 6,481,356 (Gualandi) discloses an enclosed projectile with external ridges on the enclosure for a firearm cartridge. This reference relates to firearm cartridges, and does not relate to muzzleloading firearms. Also, in this reference, the enclosure separates from the side walls of the projectile immediately upon firing, so the enclosure does not interact with the projectile after firing like a sabot does.

U.S. Published Patent Application #2004/0079256 A1 (McMurray, et al.) also discloses an enclosed projectile with interconnected collapsible fins which create a compression section for a firearm cartridge. Therefore, this reference also does not relate to muzzleloading firearms. Also, in this reference there is no disclosure that the collapsible fins interact with the bore of the rifle after firing like a sabot does.

There is a need for a saboted projectile for muzzleloading firearms which acts to securely keep the bullet in the barrel, even during the rigors of hunting. Also, there is a need for such a saboted projectile which is easy and convenient to load, especially after the barrel has been fouled by earlier shooting. The present invention addresses these needs.

SUMMARY OF THE INVENTION

The present invention is a saboted projectile with external ridges and/or an internal locking edge for muzzleloading firearms. Also, the present invention is a sabot with the ridges and/or locking edge for receiving a muzzleloading projectile. The sabot is preferably a soft plastic piece, and has a forward part and a rearward part. Preferably, the forward part has a plurality of axial panel sections separated by narrow, axial slots. There may be two, three, four or more forward panels. The panels have radial ridges on their outside, or external surfaces. There may be one, two, three or more spaced-apart external ridges. Also, the panels have a radial ridge on their inside, or internal surfaces. There may be one, two or more spaced-apart internal ridges. Typically, the external and internal ridges are between about 0.001" and 0.006" high, and between about 0.001" and 0.003" wide.

The external radial ridges assist in convenient loading of the muzzleloading projectile, while still providing enough contact with the inside of rifle barrel to efficiently capture exploding gases and prevent blow-by. The external radial ridges provide less total surface area in contact with the rifle bore, compared to a smooth surface sabot. This way, there is less sabot-on-bore friction during loading, which is especially attractive when the bore has been fouled by earlier shooting.

The internal radial ridge assists in securing the sabot to the bullet, especially when the bullet has been provided with a cooperating radial indent, cannelure or retaining ring. The geometry of the internal radial ridge and the bullet retaining ring may be adjusted relatively to more securely interfit and interconnect. For example, a slightly deeper groove at the rearward edge of the bullet retaining ring may cooperate with a slightly longer extending portion of the internal radial ridge of the sabot at that same location. This way, the sabot is more firmly secured to the bullet, and vice-versa. Consequently, when the saboted projectile of the present invention is seated in the bore in front of the power charge, the bullet will not easily separate from the sabot, and will not easily fall out of the barrel.

Preferably, the rearward part of the sabot has a cup-shaped gas check portion formed at the rear end. For the gas check portion, the external walls are generally axial. However, the interior walls of the gas check generally taper to be more thin towards the rear end. This way, the gas check is flexible enough at the rear end to provide a good seal in the bore, yet rigid and durable enough at the front end to prevent excessive deformation, and possibly prevent even rupture, upon explosion of the powder charge behind the gas check.

DESCRIPTION OF THE PREFERRED EMBODIMENTS

Referring to the Figures, there is depicted one, but not the only, embodiment of a saboted projectile 10 according to the present invention.

Figure 1:
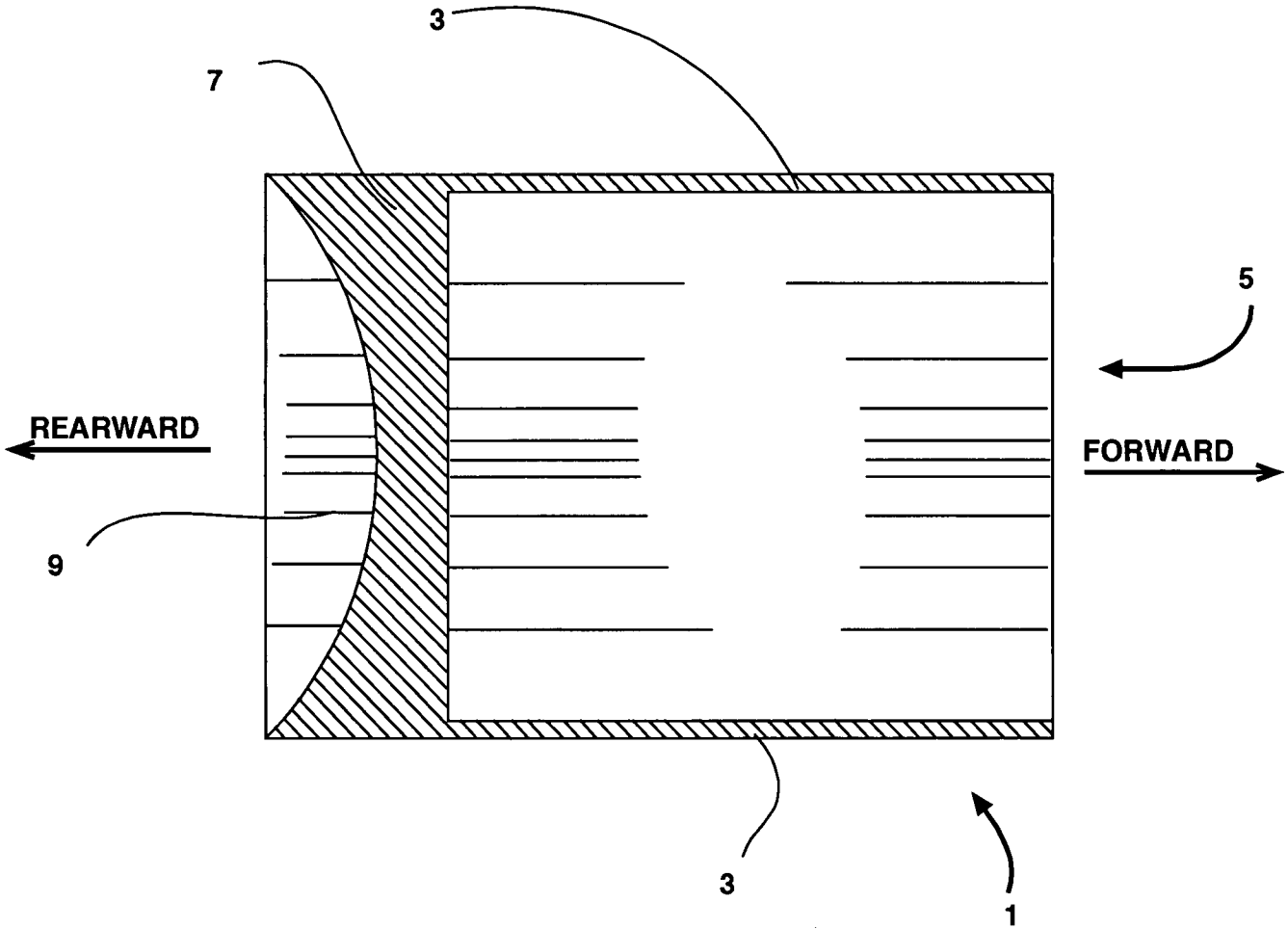
FIG. 1 PRIOR ART
FIG. 1 is a schematic cross-sectional side view of a prior art sabot.

First, in FIG. 1, there is depicted a prior art sabot 1. Sabot 1 has generally axial side walls 3, with an open forward end 5 and a closed rearward end 7. The direction of the projectile in the firearm is shown in the Figure. Open forward end 5 defines an open space for receiving a bullet (not shown) in the sabot. At the rear end of rearward end 7 may be a cup-shaped gas check section 9. Typically, side walls 3 of prior art sabot 1 are substantially axial, and interact with the bullet there-between in a friction fit mostly all along the outside surface of the walls. For a muzzleloading firearm, the outer diameter of sabot 1 is at least as great as the inner diameter, or caliber, of the firearm barrel. Often, the sabot 1 is slightly over-sized, for example, 0.005" greater than the inner diameter of the bore. The bullet (not shown) however, is typically under-sized, for example, 0.003" less than the inner diameter of the bore. Since a strong seal is needed to trap propellant gases behind the bullet, and to keep the bullet centered in the barrel, the sabot fills the gap between the bullet and the bore. If the barrel is rifled, the sabot engages and spins in the rifling, and imparts its spin to the bullet when the sabot is tightly fit to the bullet.

Figure 2:
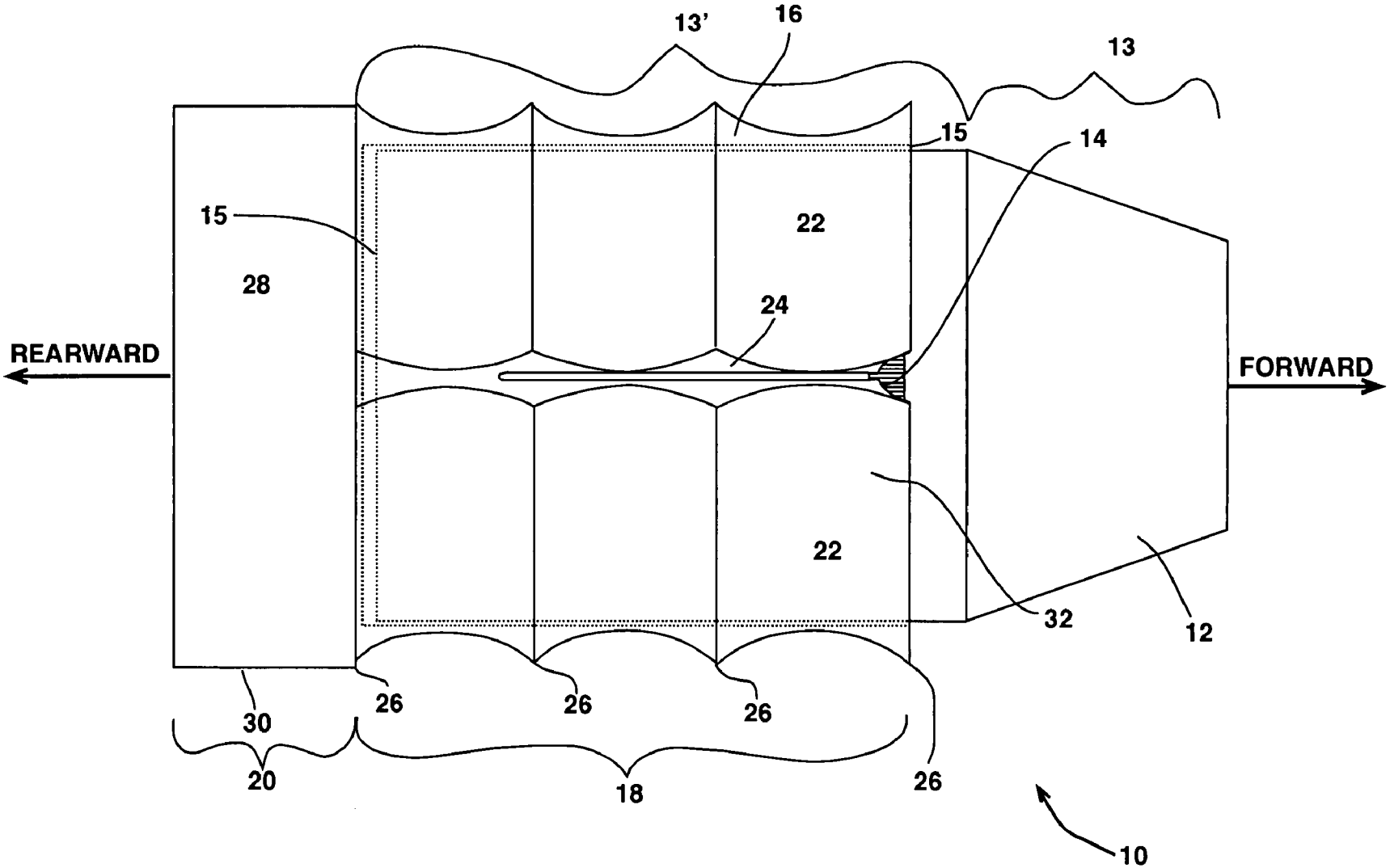
FIG. 2 is a schematic side view of one embodiment of the projectile of the instant invention.

According to an embodiment the present invention, in FIG. 2 there is depicted a side view of the saboted projectile 10. Projectile 10 has a bullet 12 at its front end. Bullet 12 has a forward part 13, and a rearward part, 13'. The direction of the projectile in the firearm is shown in the Figure. Near the middle of bullet 12, between forward part 13 and rearward part 13', is a retaining ring 14. Retaining ring 14 in this case is an annular indent with axial scoring. Projectile 10 also has a sabot 16 at its rear end. Sabot 16 has a forward part 18 and a rearward part 20. The forward part of 18 of sabot 16 has a generally axial cylindrical opening 15 therein for receiving the rearward part 13' of the bullet. The forward part 18 of sabot 16 has a plurality of axial panel sections 22 separated by relatively narrow, axial slots 24. Slots 24 extend part of the way from the forward end to near the middle of sabot 16. Panel sections 22 have radial ridges 26 on their outside, external surfaces. There may be two, three, four or more panel sections 22. Preferably, there are 4.

The rearward part 20 of sabot 16 has a gas check portion 28 with generally axial side wall 30. However, side wall 30 may have a slight outward taper towards the rear end of gas check 28 in order to provide a good gas seal in the bore upon explosion of the powder charge behind the gas check.

Figure 3:
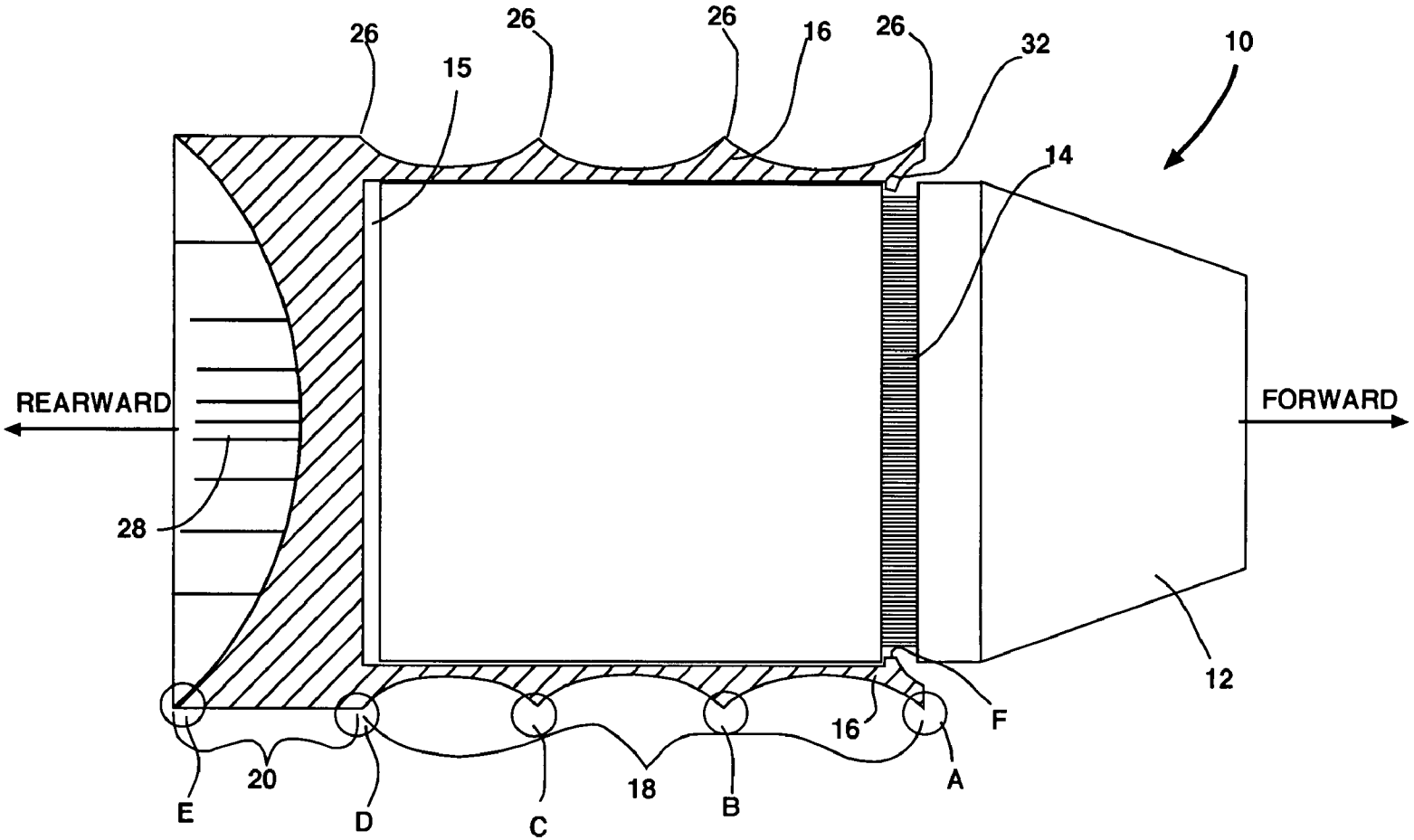
FIG. 3 is a schematic cross-sectional view of the embodiment depicted in FIG. 2.

In FIG. 3 there is depicted a cross-sectional view of the embodiment of the present invention depicted in FIG. 2. Saboted projectile 10 has bullet 12 at its front end and sabot 16 at its rear end. Bullet 12 has retaining ring 14. Sabot 16 has forward part 18 and rearward part 20 with gas check section 28. Sabot forward part 18 as radial ridges 26 on its outside surface. Also, sabot forward part 18 has a radial ridge 32 near the top of its inner surface. Inner radial ridge 32 cooperates and interfits with bullet retaining ring 14. There may be more than one inner radial ridge 32, and more than one bullet retaining ring 14.

The sabot projectile of this invention comprises external ridges and/or an internal locking edge. The external ridges are made of specific dimensions to allow for easy loading. The internal locking edge is made to match the dimensions of the bullet's crimp ring in order to more securely lock the bullet to the sabot. In one embodiment, the invented sabot may have only one or more external radial ridge(s), and no internal radial ridge. In another embodiment, the invented sabot may have one or more internal radial ridges, and no external radial ridge(s). In another embodiment, the invented sabot may have both one or more external and internal ridges.

In a preferred embodiment of the invention, there are six points wherein nearly exact dimensions of the saboted projectile are very important. These six points are identified as #A-#F in FIG. 3. For example, for a 50 caliber barrel bore;

point #A is 0.508" in diameter
point #B is 0.502" in diameter
point #C is 0.502" in diameter
point #D is 0.505" in diameter
point #E is 0.507" in diameter, and
point #F is 0.495" in diameter.

Likewise, preferably for a 45 caliber barrel bore;

point #A is 0.458" in diameter
point #B is 0.452" in diameter
point #C is 0.452" in diameter
point #D is 0.455" in diameter
point #E is 0.457" in diameter, and
point #F is 0.445" in diameter.

Points #A through #E will hold the bullet centered in the barrel. Point #A also forces point #5 into the crimp ring on the bullet for a more positive lock, assuring that the bullet remains in the exact same position in the barrel when the firearm is being handled at the range or in the field.

Points #B and #C are smaller in diameter to allow ease of loading but will engage the rifling when the weapon is fired, therefore helping to transfer the spin of the rifling to the bullet.

Point #D is the most solid part of the sabot and has to withstand a lot of pressure and maintain its integrity for an even push on the bullet to achieve optimum performance.

Point #E must be flexible enough to allow for an easy start of the bullet but maintain an absolute seal to prevent "blow by" of the powder and gases upon firing. Points #A and #E provide the most friction for holding the sabot securely in the barrel that has typically an inner diameter of 0.500" for a .50 caliber or 0.450" for a .45 caliber.

Point #F fits into the crimp ring of the specially designed bullet. This combination will lock the bullet into the sabot even before it is pushed into the friction fit bore. After the projectile is pushed into the bore, the bullet is locked very securely into the sabot at this point. This will allow the shooter to carry the saboted projectile and not have it fall out of the firearm. It will also create a positive, reproducible lock when it is loaded into the bore.

Figure 4:
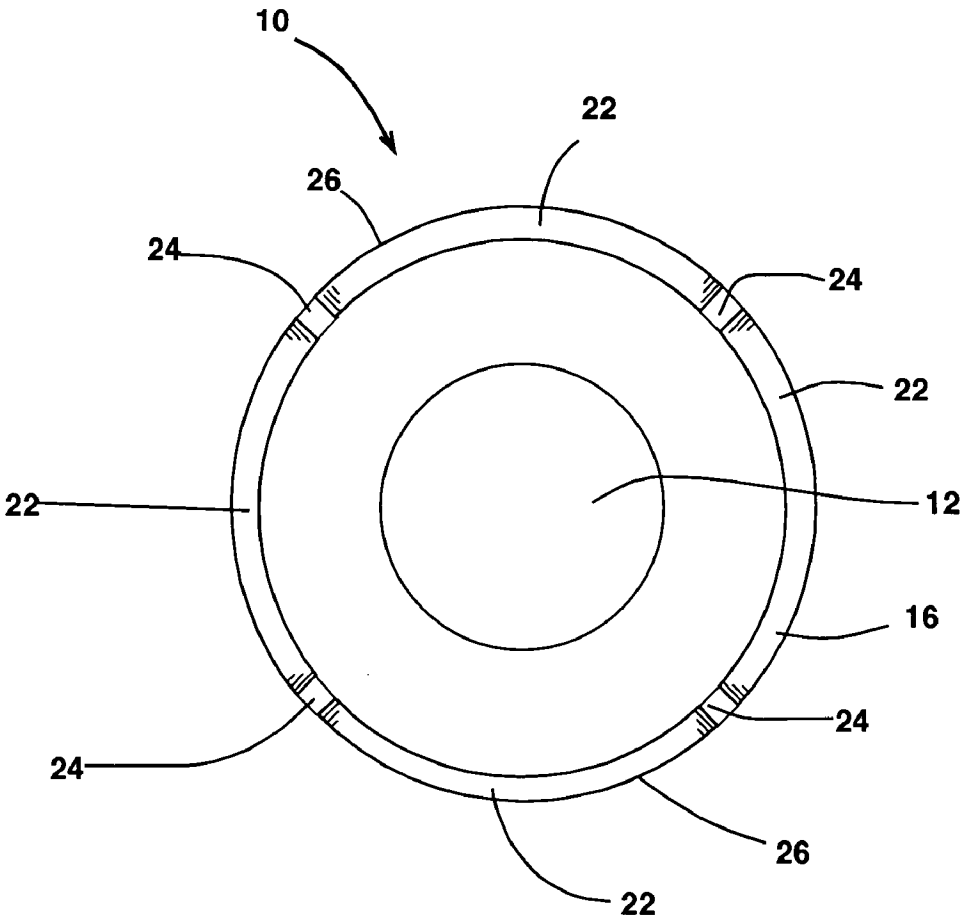
FIG. 4 is a top view of the embodiment depicted in FIGS. 2 and 3.

In FIG. 4 there is depicted a top view of the embodiment of the invention 10 depicted in FIG. 2. Bullet 12 is visible at the top of sabot 16. Sabot 16 has axial panel sections 22 separated by narrow, axial slots 24. It is clear from this Figure that the outer diameter (o.d.) of sabot 16 is greater than the outer diameter (o.d.) of the bullet 12. This way, when properly sized relative to the firearm bore, the outer surface of the sabot engages the inner surface of the firearm bore, and the bullet does not engage the bore.

Figure 5A:
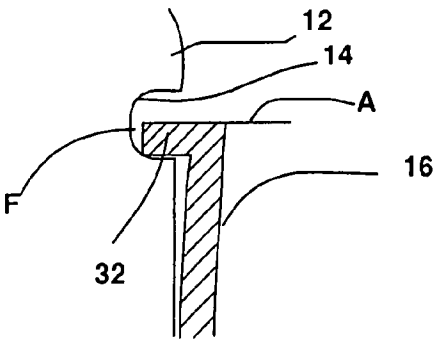
FIGS. 5A, B and C is a series of schematic, cross-sectional side detail views depicting the interfit between the internal ridge of the sabot and the retaining ring of the bullet, according to several embodiments of the invention.
Figure 5B:
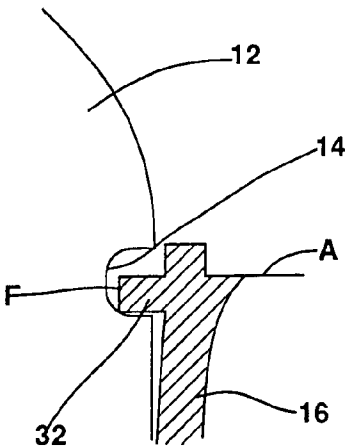
Figure 5C:
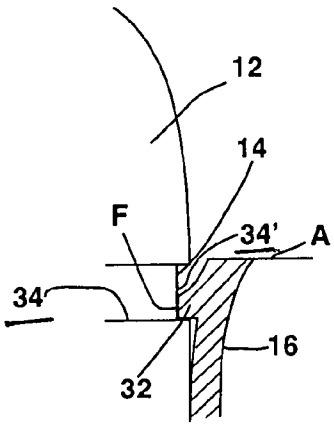

In FIGS. 5A, 5B and 5C there are depicted three (3) cross-sectional side views of the interfit connection between the ridge on the internal surface of the sabot and the retaining, or crimp ring of the bullet. In FIG. 5A, internal ridge 32 extends inwardly from the inner surface of sabot 16. Point F of internal ridge 32 fits into retaining 14 ring on bullet 12. This way, sabot 16 is securely attached to bullet 12, and vice-versa. In FIG. 5A, internal ridge 32 is at or near the front edge of sabot 16.

In FIG. 5B, internal ridge 32 is further back from the front edge of sabot 16. This way, for example, the tightness of the securement between the sabot 16 and bullet 12 may be adjusted. In the case wherein internal ridge 32 is at or near the front edge of sabot 16 (as depicted in FIG. 5A), less resistance pressure is required at or near point A in order to flex the sabot 16 outside wall and remove the sabot from the bullet 12, resulting is a less secure fit. In the case wherein internal ridge 32 is further back from the front edge of sabot 16 (as depicted in FIG. 5B), more resistance pressure from the front of the projectile is required at or near point A in order to flex the sabot 16 outside wall and remove the sabot from the bullet 12, resulting in a more secure fit.

In FIG. 5C internal ridge 32 of sabot 16 extends inwardly over bullet radial ledge surface 34 towards bullet axial ledge surface 34'. This way, ledge surfaces 34 and 34' form a radial shoulder in bullet 12, and the shoulder is a radial indent equivalent to retaining ring 14.

Although this invention has been described above with reference to particular means, materials and embodiments, it is to be understood that the invention is not limited to these disclosed particulars, but extends instead to all equivalents within the scope of the following claims.

I claim:

1. A saboted projectile for a muzzleloading firearm, comprising:

a generally cylindrical bullet with a bullet forward part and a bullet rearward part, there being a radial indent in the bullet between the forward part and the rearward part;

a generally cylindrical sabot with a sabot forward part having a front edge and a sabot rearward part, there being a generally axial opening in the sabot forward part for receiving the rearward part of said bullet, so that the sabot forward part extends around said bullet rearward part; and, said sabot forward part having a plurality of axial panel sections separated by slots, said axial panel sections having an inside surface and an outside surface, and having an internal radial ridge on said inside surface, and having a plurality of external radial ridges on said outside surface;

wherein said plurality of external radial ridges comprises a forwardmost external radial ridge having a greater diameter than all other of said plurality of external radial ridges so that said forwardmost external ridge protrudes radially outward farther than all other of said plurality of external radial ridges; and wherein said internal radial ridge is nearer to said forwardmost external radial ridge than to all other of said plurality of external radial ridges, wherein said internal radial ridge and said radial indent are at or near said front edge of the sabot forward part, and wherein said internal radial ridge is forced into said radial indent when the saboted projectile is pushed into the muzzle of the firearm.

2. A sabot for a muzzleloading projectile, comprising:

a generally cylindrical sabot body with a sabot forward part having a front edge and a sabot rearward part, there being a generally axial opening in the sabot forward part for receiving the projectile, so that the sabot forward part is adapted to extend around said projectile;

said sabot body having an outside surface, and said sabot forward part having an inside surface in the region of the generally axial opening;

there being a plurality of external radial ridges on said outside surface comprising a frontmost external radial ridge having a greater diameter than any other of said plurality of external radial ridges so that said forwardmost external ridge protrudes radially outward farther than all other of said plurality of external radial ridges;

there being an internal radial ridge on said inside surface;

wherein both of said frontmost external radial ridge and said internal radial ridge are at or near the front edge of the sabot forward part and the internal radial ridge is nearer to said frontmost external radial ridge than to any other of said plurality of external radial ridges; and wherein, upon pushing the sabot into a muzzle of a firearm, the frontmost external radial ridge forces said internal radial ridge inward for locking into an indent in the projectile to retain the projectile in the sabot.

3. The saboted projectile of claim 1, wherein said rearward part of the sabot is a gas check having a generally axial side wall that tapers outward towards a rear end of the gas check, and wherein said frontmost external ridge diameter is greater than the diameter of the gas check axial side wall at said rear end.

4. The saboted projectile of claim 1, wherein said rearward part of the sabot is a gas check having a generally axial side wall, and the sabot has two of said external ridges between said frontmost external ridge and the gas check.

5. The saboted projectile of claim 1, wherein said internal radial ridge is rearward of said frontmost external radial ridge.

6. The sabot of claim 2, wherein said sabot rearward part is a gas check having a generally axial side wall that tapers outward toward a rear end of the gas check, and wherein said frontmost external ridge diameter is greater than the diameter of the axial side wall at said rear end.

7. The sabot of claim 2, wherein said rearward part of the sabot is a gas check having a generally axial side wall, and the sabot has two of said external ridges between said frontmost external ridge and the gas check.

8. The sabot of claim 1, wherein said internal radial ridge is rearward of said frontmost external radial ridge.

* * * * *